US005755064A

United States Patent [19]

Meyer et al.

[11] Patent Number: 5,755,064

[45] Date of Patent: May 26, 1998

[54] CARPORT ENCLOSURE WITH ONE OR MORE GARAGE DOORS

[75] Inventors: Gilbert M. Meyer, Los Altos Hills; Morton L. Newman, Hillsborough, both of Calif.

[73] Assignee: Bay Apartment Communities, Inc., San Jose, Calif.

[21] Appl. No.: 622,201

[22] Filed: Mar. 26, 1996

[51] Int. Cl.[6] ..... E04H 6/08

[52] U.S. Cl. ..... 52/174; 52/169.9; 52/299; D25/34

[58] Field of Search ..... 52/92.1, 169.9, 52/174, 299; D25/34; 160/201

[56] References Cited

U.S. PATENT DOCUMENTS

| | | | |
|---|---|---|---|
| D. 195,761 | 7/1963 | McVicar e tal. | D25/34 X |
| D. 196,231 | 9/1963 | Flagg | D25/34 X |
| D. 284,101 | 6/1986 | Latimer | D25/34 X |
| 1,907,119 | 5/1933 | Reynolds . | |
| 3,667,172 | 6/1972 | Erickson | 52/143 X |
| 3,668,828 | 6/1972 | Nicholas et al. | 52/92.1 |
| 3,678,639 | 7/1972 | Panitz . | |
| 4,078,343 | 3/1978 | Moore, Jr. . | |
| 4,133,148 | 1/1979 | Swenumson | D25/34 X |
| 4,312,160 | 1/1982 | Wilbanks | 52/92.1 |
| 4,481,744 | 11/1984 | Park | 52/92.1 |
| 4,573,293 | 3/1986 | Park | 52/92.1 |
| 4,656,797 | 4/1987 | Marquart . | |
| 4,784,383 | 11/1988 | Roberts | D25/22 X |
| 4,882,806 | 11/1989 | Davis | 160/201 X |
| 4,984,399 | 1/1991 | Taylor | D75/34 X |
| 5,216,850 | 6/1993 | Kemper et al. . | |
| 5,265,384 | 11/1993 | Menke et al. . | |
| 5,335,462 | 8/1994 | Park | 52/92.1 X |
| 5,454,201 | 10/1995 | Slonim | 52/92.1 X |
| 5,501,043 | 3/1996 | Park | 52/92.1 |

*Primary Examiner*—Carl D. Friedman
*Assistant Examiner*—Yvonne Horton-Richardson
*Attorney, Agent, or Firm*—Oppenheimer Poms Smith

[57] ABSTRACT

A carport enclosure built around an existing carport. The carport itself includes a plurality of carport support posts secured upright by respective footings and a roof supported by the support posts and overhanging the support posts. Enclosure posts, supported upright by footings, are positioned outboard of the carport support posts. A first side or end wall is attached to and supported by at least one of the enclosure posts, disposed underneath the roof and extends at least substantially up thereto so as to appear to be an integral side wall. Similarly, a second side or end wall is attached to and supported by at least one of the enclosure posts, disposed underneath an opposite side of the roof and extends at least substantially up thereto so as to appear to be an integral side wall. A rear wall is attached to and supported by at least one of the enclosure posts so as to appear to be an integral rear wall. And a segmented roll-up garage door supported by at least two of the enclosure posts is operatively moveable between an open position generally up into the carport for entry of a vehicle(s) into the carport and a door closed position. The garage door forms part of a front wall which also extends up to the roof. In other words, the end and rear walls, which can have a latticework construction, and the front roll-up garage door wall are structurally independent of the carport. However, because of their proximity relative to the carport roof, the enclosure construction together with the carport advantageously give the appearance of an integral garage-like construction and has similar enclosure advantages.

45 Claims, 9 Drawing Sheets

CARPORT ENCLOSURE WITH ONE OR MORE GARAGE DOORS

BACKGROUND OF THE INVENTION

Carports typically are constructed with support posts supporting a roof over a (concrete) driveway and with all sides of the carport being open. The vehicle(s) parked in the carport under the roof are protected from falling snow, rain, hail and sleet, and the hot mid-day sun, as are people as they immediately embark or disembark from the vehicle(s). However, strong winds can blow the snow, rain, etc., through the open sides to and against the vehicles and people getting in and out of them. Further, the open carport sides subject the area around the vehicle to the temperature extremes of the weather and seasons. Also, the open sides leave the vehicle and any nearby objects readily visible and vulnerable to theft or vandalism. Additionally, many people find the open sided, low cost construction of carports to be unattractive, especially when compared with neatly constructed and enclosed garages.

SUMMARY OF THE INVENTION

Accordingly, the present invention provides a simple construction and method for substantially enclosing existing carports to give the general appearance and many of the advantages of newly-built garages which have one or more garage doors. The present enclosure construction takes advantage of the existing carport construction, which includes a plurality of posts supporting a carport roof that overhangs the posts.

The enclosure includes a plurality of enclosure posts supported upright by respective footings, positioned outboard of the carport support posts and generally underneath edges of the roof. Side (or end) walls and a rear wall are attached to respective ones of the enclosure posts and extend up to the roof. These walls preferably provide no structural support for the roof. However, they do extend at least substantially up to the roof to give the appearance of being integral (garage-type) walls. The walls have a framing secured to the enclosure posts and paneling secured to the framing. The paneling is preferably an open latticework or similar open construction.

At least one garage door is mounted at the carport front entrance, supported by the enclosure posts and movable between open and closed positions. A top rail with attached trim above the garage door helps make the garage door front wall appear to be the front of an integral garage-type structure (together with the side and rear walls and the roof. More than one garage door can be mounted at the front of the carport, assuming the carport size and construction will accommodate them, providing separate access to different vehicle stalls underneath the roof. Extra enclosure supports can be used to support additional garage doors. If the garage door is double wide, larger side supports and footings may be needed. A pair of parallel spaced tracks supported by the enclosure posts curve up into the carport and support the roller ends of the segmented roll-up garage door and guide it between its open and closed positions. The tracks are attached at their upper ends to the beams of the carport roof.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
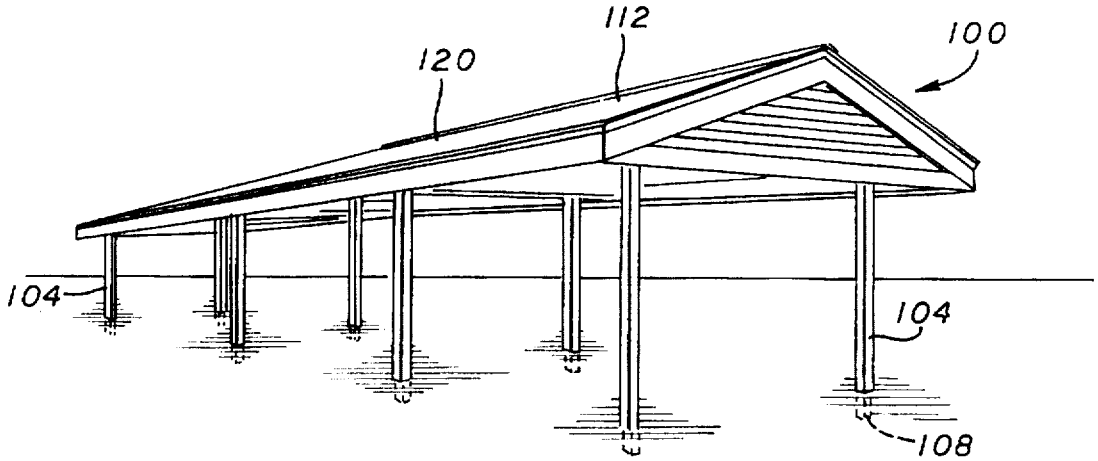
FIG. 1 is a perspective view of a carport to be enclosed pursuant to this invention.

The present invention will now be described with reference to the accompanying drawings. In particular, FIG. 1 shows generally at 100 an existing carport such as those known and typically found in the prior art. It basically comprises a plurality of steel posts 104 secured upright in respective footings 108 and a roof construction 112 supported by the posts. The gable roof construction 112 includes as shown, for example, in FIGS. 7 and 12, plywood sheets 116 supporting composition shingle roofing 120, flashing 124, wood fascia 128, taper cut purlin 132, angled supports 134, horizontal siding 136, rake boards 138, rafters 140 and side trim 144. The roof 112 extends peripherally out at a distance beyond the posts 104, overhanging them.

The enclosure shown generally at 160, including garage doors 200, 204, 206, 208, 210 of this invention, are built around the posts 104 and under the overhanging roof 112. See FIGS. 2 and 6, for example. They thereby give the outward appearance of an integrally formed garage structure 112 with the left side, right side and rear enclosure walls shown generally at 170, 180, 190, respectively (and their underlying structural posts) appearing to support the roof 112. This can be understood from FIG. 2 which shows a front perspective view of an enclosure 220 including the garage doors 200, 204, 206, 208, 210 of this invention built essentially around the carport 100 of FIG. 1. The enclosure 220 as illustrated has the multiple garage doors (with one (208) illustrated in an open position) to provide stalls for multiple vehicles, such as vehicle 230.

Figure 3:
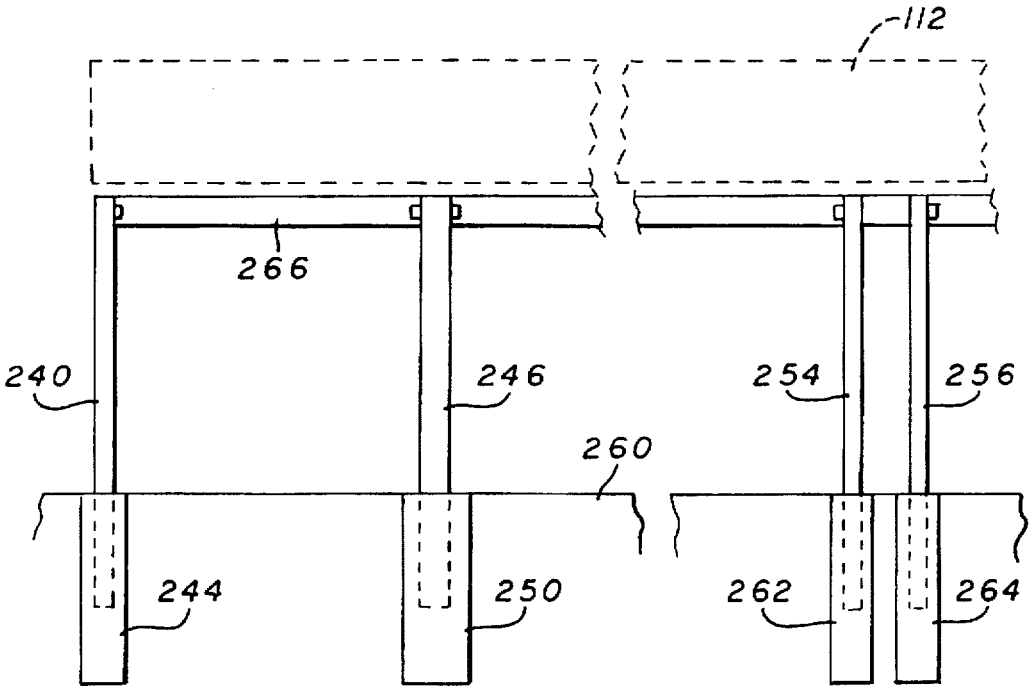
FIG. 3 is a front elevational view of a portion of the garage door wall of the enclosure of FIG. 2.

FIG. 3 shows the (left side) of the front garage door wall including an end C6×4×12 gauge or enclosure post 240 in a fourteen inch diameter by five foot deep footing 244, an adjacent C10×4×12 gauge or enclosure post 246 in a twenty inch diameter by five foot deep footing 250. On the right of that figure are illustrated a pair of C5×4×12 gauge jamb or enclosure posts 254, 256, each twelve inches in diameter. Each of these (four) posts extends up about eight feet from the ground or cement surface 260 and three feet down into its five foot deep footings 262, 264 (or a single footing for both). A C11×12 gauge header 266 extends across the tops of these posts. The sizes and types of the posts, headings, rails and footings will be selected by the designer as needed for the desired uses, sizes, appearance and operating conditions.

Figure 4:
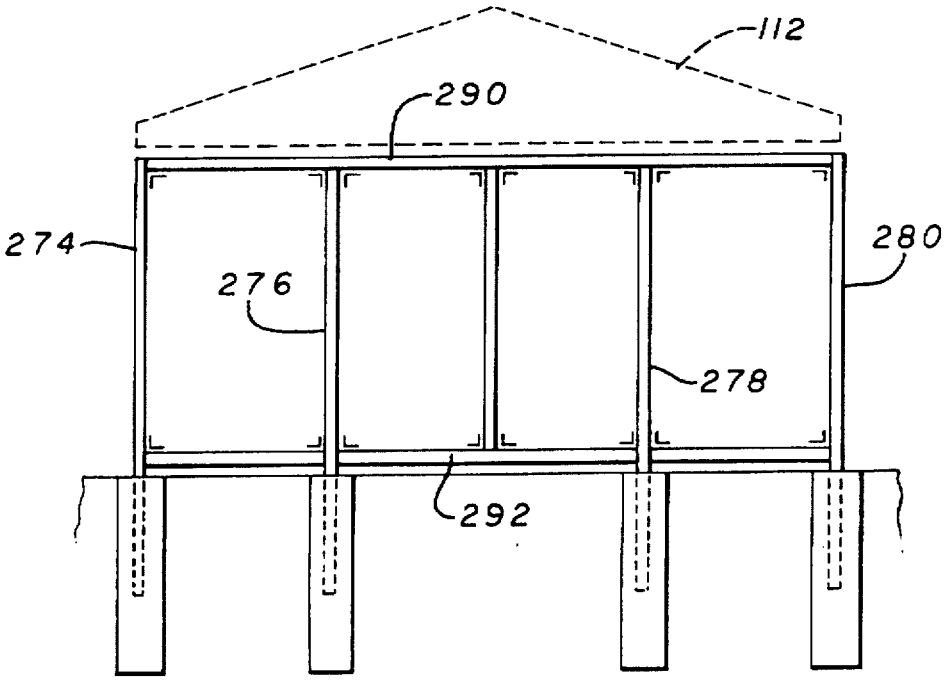
FIG. 4 is an end (right) elevational view of the end wall framing of the enclosure of FIG. 2.

An end wall framing is shown in FIG. 4 which includes double C4×2¼×16 gauge or enclosure posts (spliced over respective posts) 274, 276, 278, 280. Double C4×2¼×16 gauge rails 290, 292 spliced over posts are provided at the tops and bottoms. The footings are all five feet deep with the posts extending down three feet into them. The three on the right are each twelve inches in diameter, and the one on the left, which supports in part the adjacent garage door, is fourteen inches in diameter.

Figure 5:
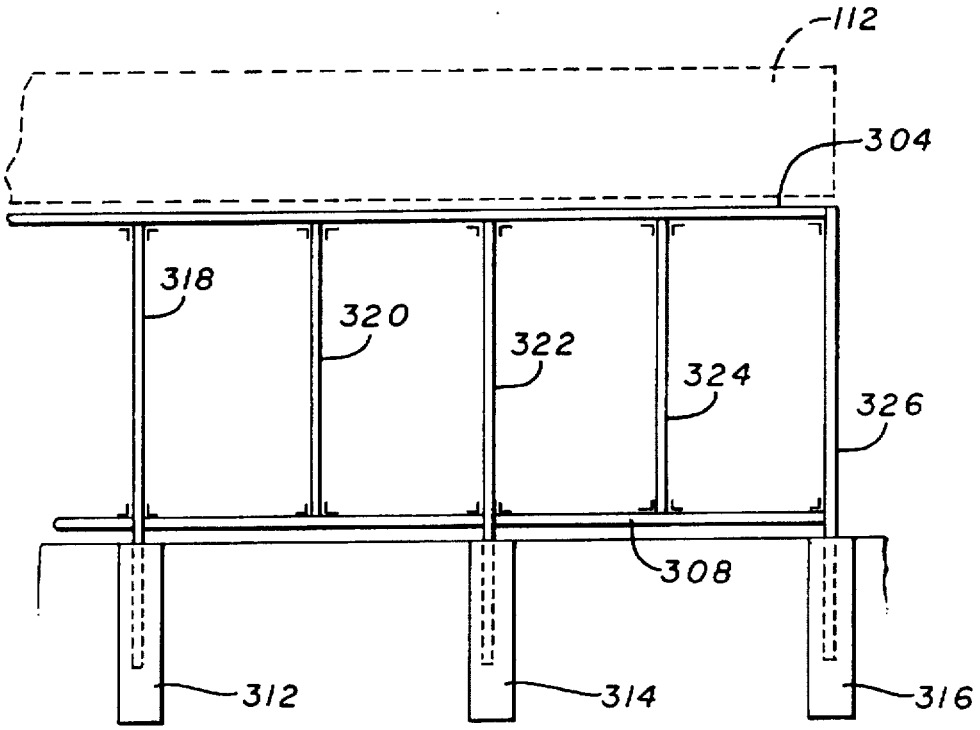
FIG. 5 is a rear elevational view of a portion of the back wall framing of the enclosure of FIG. 2.

The right side of the back wall framing is shown in FIG. 5. It includes similar top and bottom rails 304, 308, footings 312, 314, 316, and double C4×2½×16 gauge or enclosure posts 318, 320, 322, 324, 326.

Figure 2:
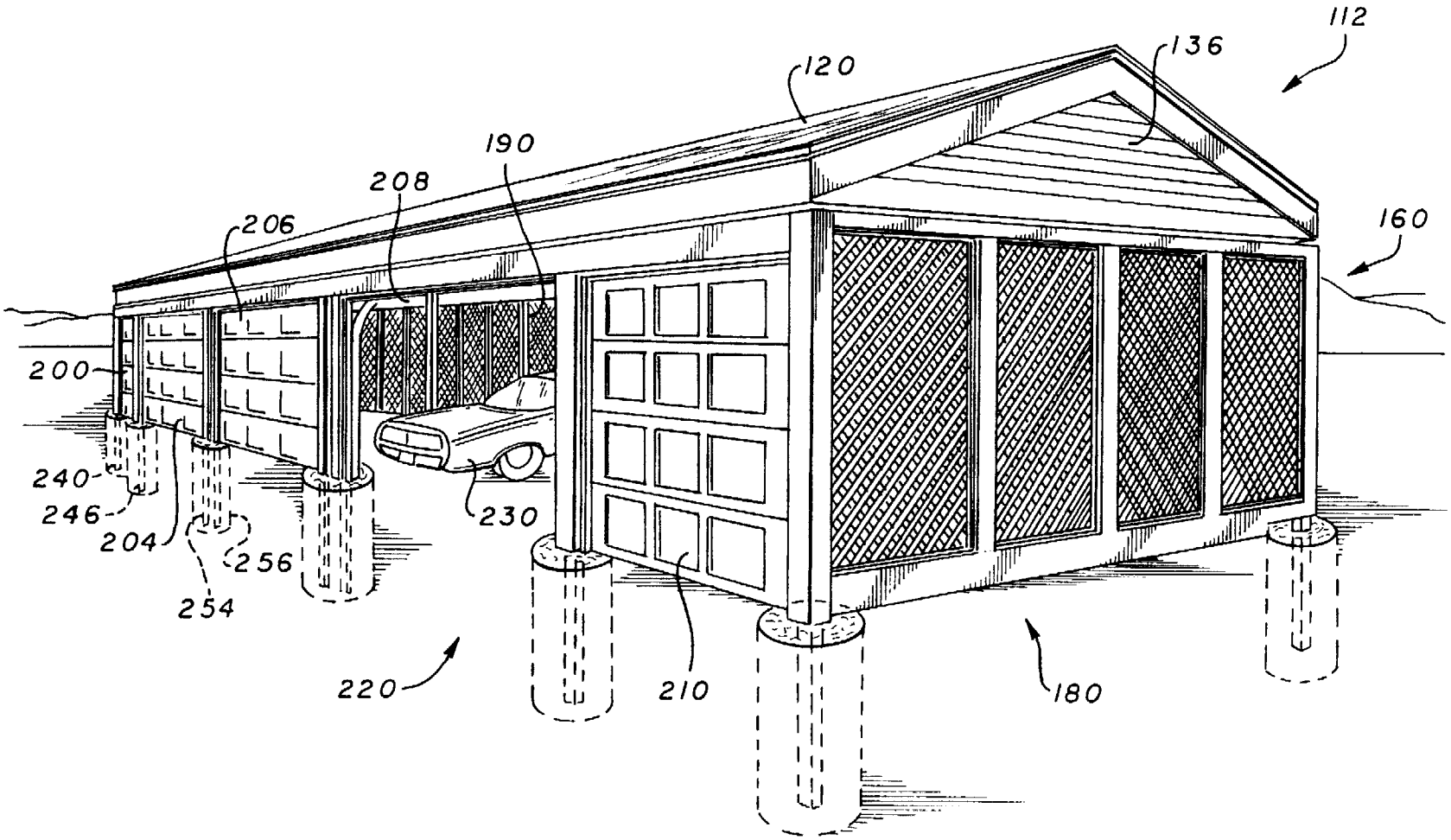
FIG. 2 is a perspective view of a carport enclosure of the present invention shown constructed around the carport of FIG. 1.
Figure 6:
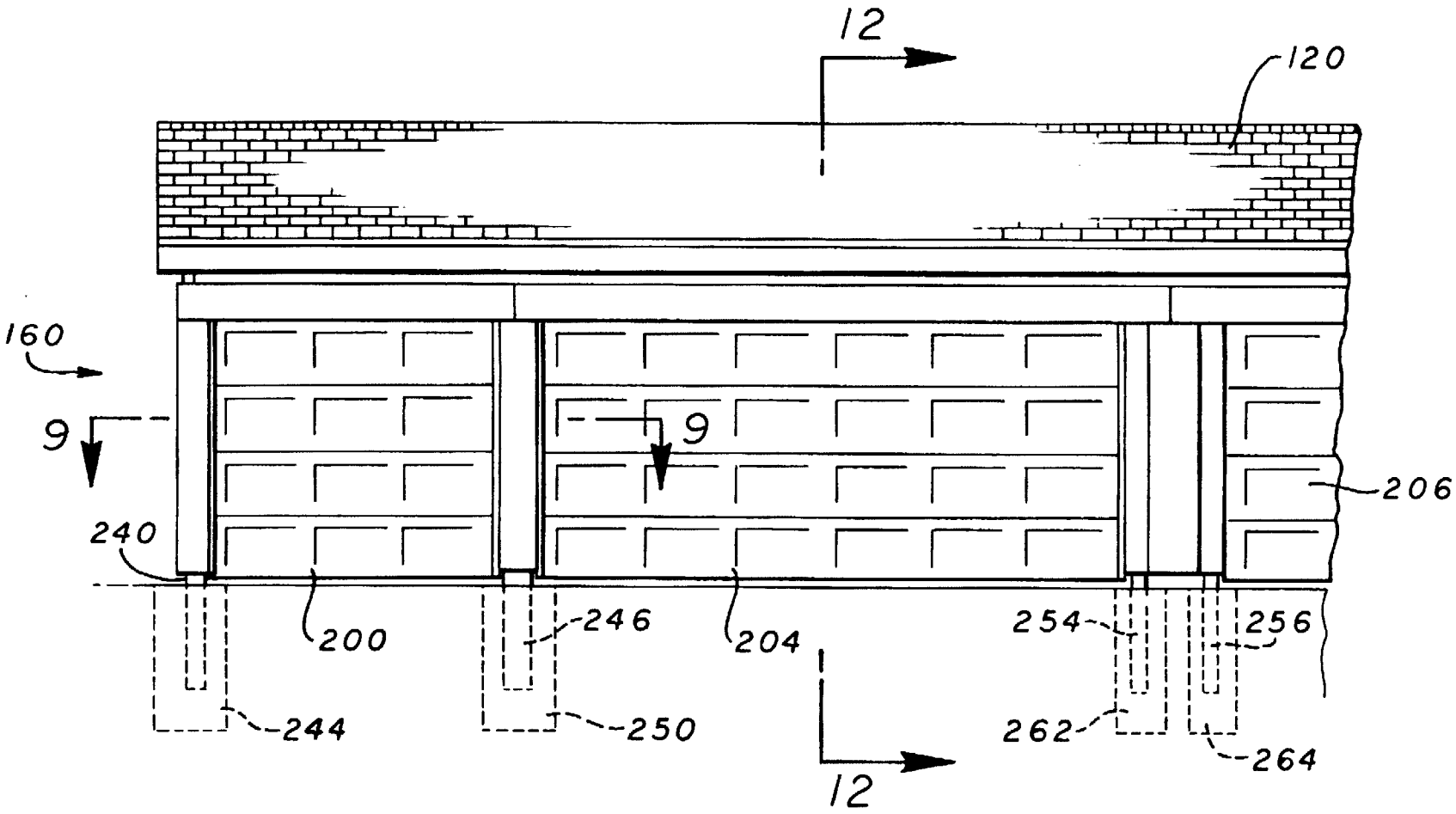
FIG. 6 is a front elevational view of a portion of the carport and enclosure of FIG. 2.

A partial front elevational view of the structure 180 is illustrated in FIG. 6. Shown in the down closed positions are a single-car garage door 200, and two double-car garage doors 204, 206. FIG. 2 shows the other double-car garage door 208 and another end single-car garage door 210. The garage doors preferably have a segmented roll-up type of construction. An example of this construction are the steel sectional roll-up doors available from Clopay.

Figure 7:
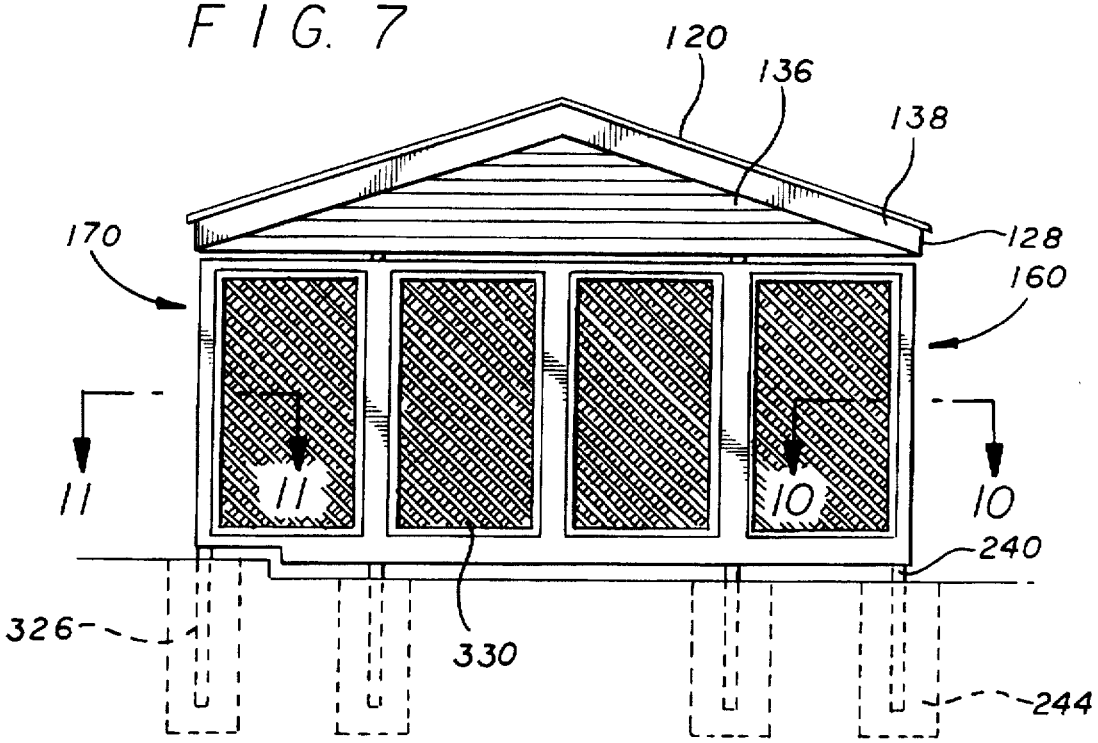
FIG. 7 is an end view of FIG. 6.
Figure 8:
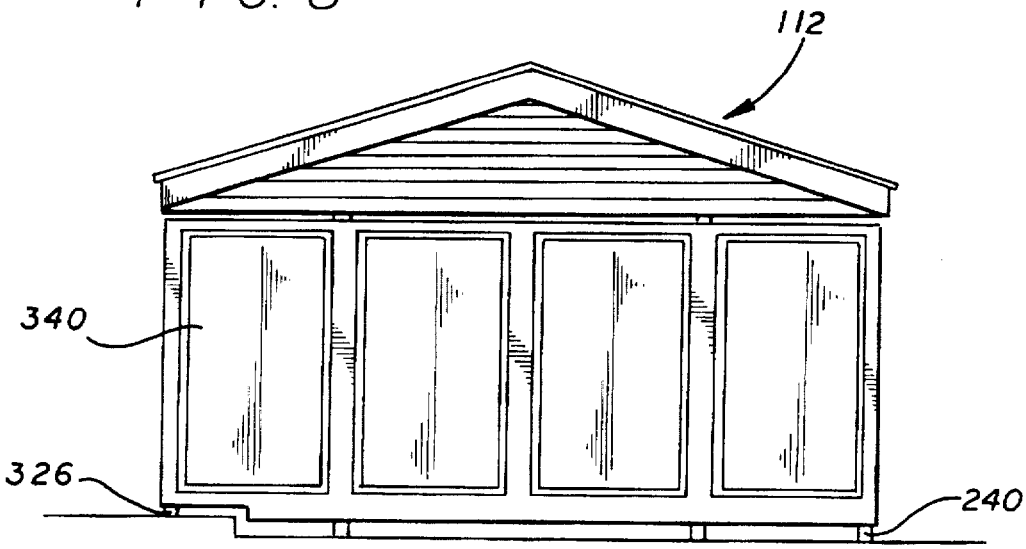
FIG. 8 is a view similar to FIG. 7 showing an alternative solid panel (instead of an open latticework) embodiment of the invention.

FIG. 7 shows the left end (or side) elevational view of the structure 180, with the right end being a mirror image thereof. It shows the preferred open-type latticework construction with four latticework panels 330. However, it is also within the scope of the present invention to use a solid lightweight panel construction, as shown in FIG. 8, generally at 340. However, the latticework construction is preferred because building code requirements typically require that this (carport enclosure) structure be open without fully enclosed walls. Using solid walls would mean that it would then be classified as a garage with additional attendant code requirements. Instead of latticework other types of "open" construction which can be used include wrought iron fencing and wood pickets.

Figure 9:
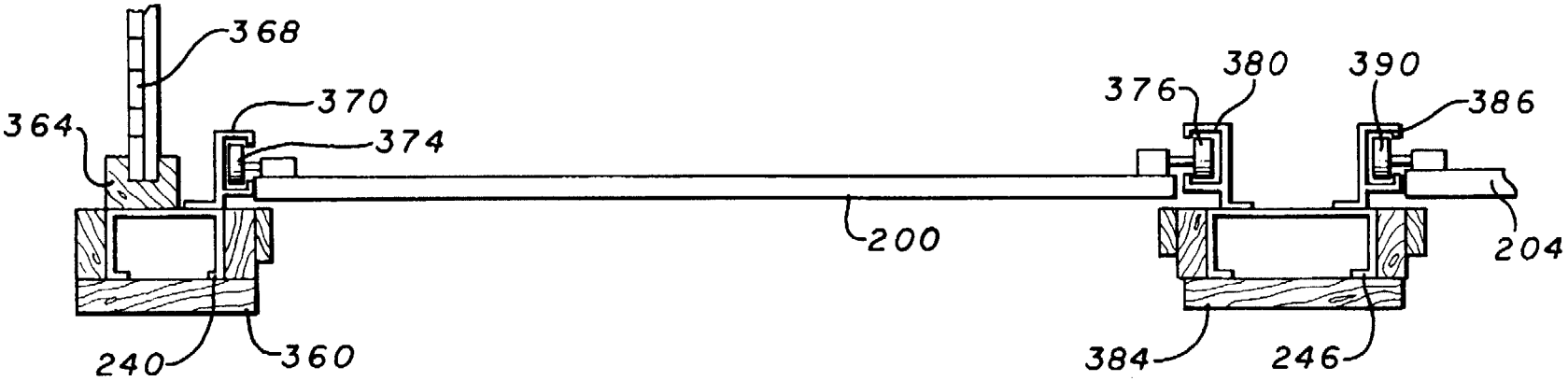
FIG. 9 is an enlarged cross-sectional view taken on line 9—9 of FIG. 6.

FIG. 9 is a cross-sectional view taken on line 9—9 of FIG. 6 showing in greater detail the mounting of the roll-up type garage door 200 to the adjacent posts. Illustrated at the lower left of that figure are the steel corner posts 240 with wood trim 360 adhered to the three outer sides. A rearward U-shaped lattice frame mold 364 is adhered to the rear side of the corner post 240, to envelope edges of the lattice panel 368 adjacent to the frame mold. Also to the rear of the corner post is the left side of the roll-up door track of the garage door 200 adjacent thereto. The (single) garage door 200 has mounted to both edges of its expanse brackets supporting at its ends rollers or wheels 374, 376. One of the rollers 347 rides in the left track 370.

The other roller 376 rides in the right rack 380, which is mounted to the inward surface of the enclosure post 246. Trim 384 is secured to the outward face and lateral sides of the post. And a left track 386 is mounted at the other end of the inward face of that post, disposed outward to receive therein for rolling and guiding engagement the left roller 390 of the adjacent (double) garage door 204. This post 246 is larger than the corner post 240 since it must support not only one half of the weight of the single (sectional) garage door 200, but also one half of the weight of the double garage door 200.

Figure 10:
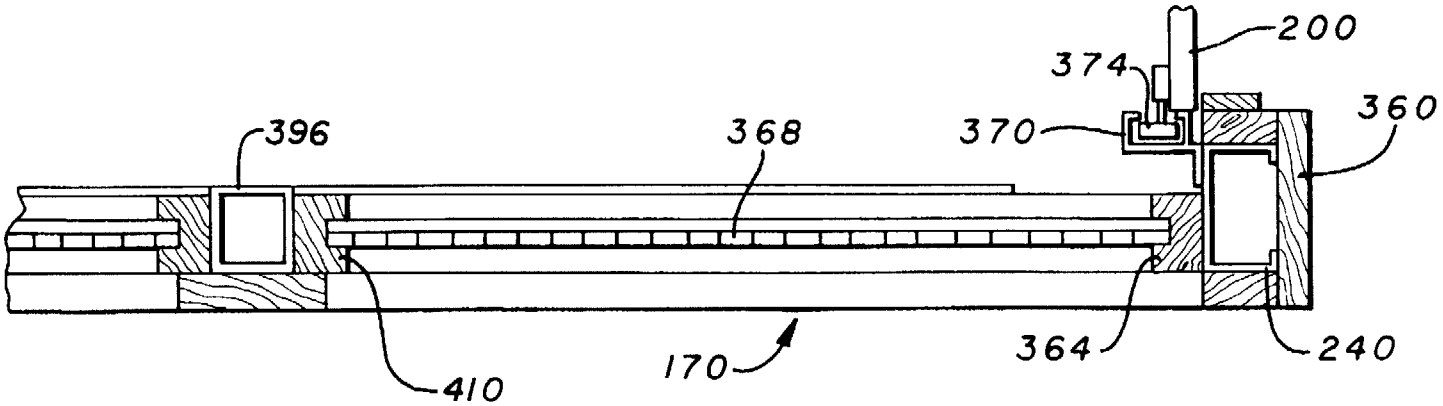
FIG. 10 is an enlarged cross-sectional view taken on line 10—10 of FIG. 7.

FIG. 10 is an enlarged cross-sectional view taken on line 10—10 of FIG. 7 of the front left corner of the enclosure. Shown therein are the corner post 240 and a side central enclosure post 396. Also shown are the trim 360 about the corner post 240, the roll-up track 370 for the end garage door 200, and U-shaped lattice frame mold 364. The mold 364 holds the latticework panel 368 at one side edge and the other side edge is held by a corresponding frame mold 410 on the side of the center post 396.

Figure 11:
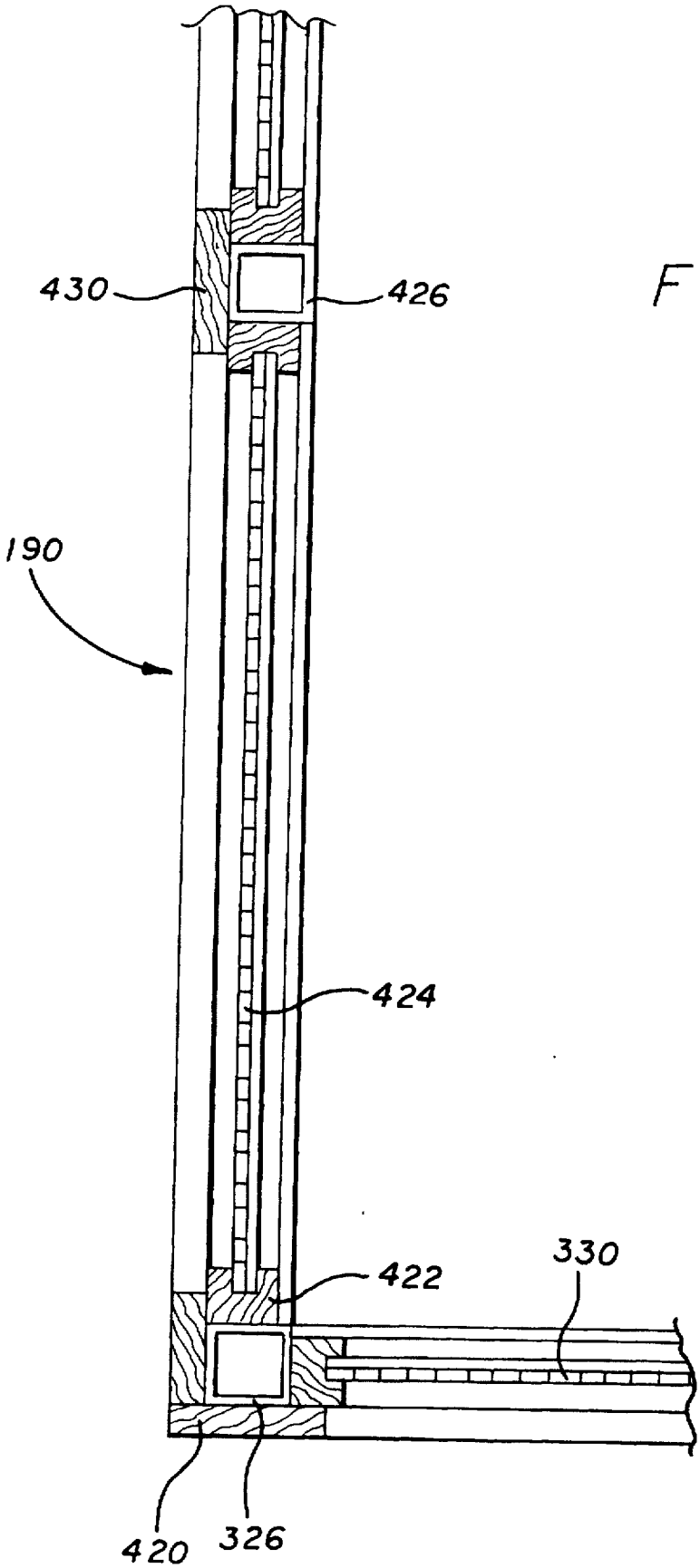
FIG. 11 is an enlarged cross-sectional view taken on line 11—11 of FIG. 7.

FIG. 11 shows a rear corner and the attachment of the trim 420, lattice mold 422 and lattice panel 424 to the rear corner and a central rear post 426 with mold 428 and trim 430 constructed in a manner similar to the previously described posts.

Figure 12:
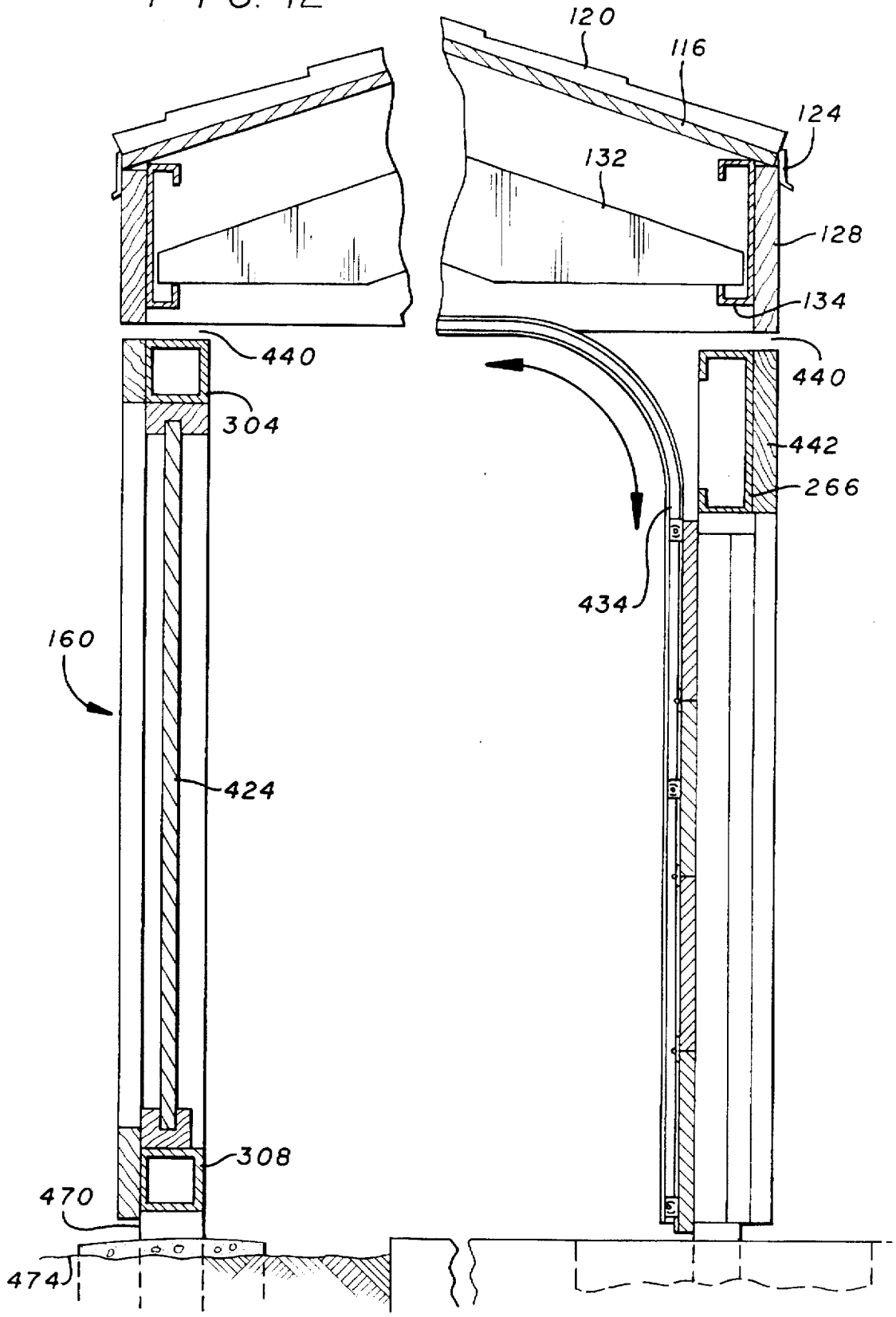
FIG. 12 is an enlarged (partial) cross-sectional view taken on line 12—12 of FIG. 6.
Figure 13:
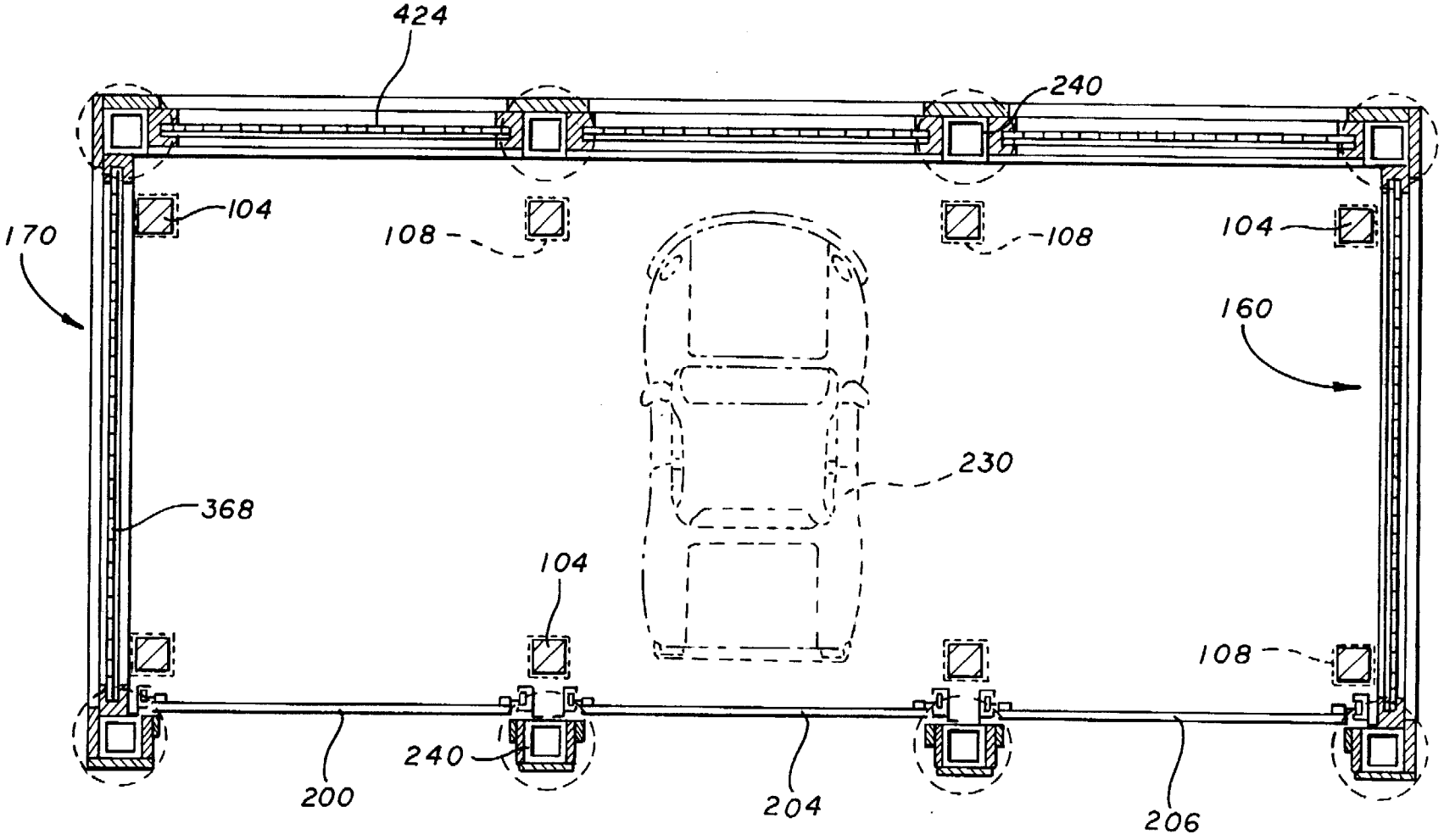
FIG. 13 is a top view of a carport enclosure of the present invention constructed around the carport of FIG. 1.

The curvature defined by the tracks 370, 380, and 434 up into the interior of the carport 100 is best shown on the upper right portion of FIG. 12. The upper ends of the tracks are attached to the carport beams that support the roof. No significant weight or structural stresses are thereby placed on the carport or its roof. The garage door, even when in its fully open position, does not transmit heavy weight forces. Any weight loading therefrom is well dispersed along the roof line, and it also is not subject to any significant wind load. The small three quarter inch separation 440 between the bottom of the wood fascia 128 of the roof structure 112 and the top of the trim 442 on the outside of the C11×4×12 gauge header 266 at the top of the front wall is shown. The separation 440 is continuous around the entire enclosure 160 as can be understood by the three quarter inch separation on the upper left side of the drawing between the bottom of the roof fascia 128 and the top of the trim on the outside of the rear wall top rail 304. The separation 440 can be covered by strips, paneling or the like, but such would be merely cosmetic and would not make the walls structural load bearing supports for the roof 112. However, adding such cosmetic paneling is not necessary since the Oatticework) structure is already open to the weather. The reasons for not structurally attaching the walls to the roof are that carports are typically built with only a minimum structural design, incapable under severe conditions (such as strong winds) of structurally supporting side walls. Also, a two inch clearance 470 between the bottom of the rear wall bottom rail 308 and the finished grade 474 is provided for drainage, to allow water to flow.

The present carport enclosure is simple of construction, takes full advantage of the existing carport roof and supports, is adaptable to different grades and environments, and supports generally any number of the roll-up garage door(s), as the carport construction can accommodate. The resulting structure is functional, inexpensive and attractive, as can be seen from FIG. 2, for example, and in ready compliance with typical building codes.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A carport enclosure, including: a plurality of carport support posts; and a roof construction supported by said support posts and generally overhanging said support posts; said support posts and said roof construction defining a carport which is open substantially on all sides thereof; wherein the improvement comprises:

a plurality of enclosure posts positioned outboard of said carport support posts;

a first side wall attached to and supported by at least one of said enclosure posts, disposed generally underneath said roof construction and extending at least substantially up thereto so as to give an appearance of being an integral garage side wall;

a second side wall attached to and supported by at least one of said enclosure posts, disposed generally underneath an opposite side of said roof construction and extending at least substantially up thereto so as to give an appearance of being an integral garage side wall;

a rear wall attached to and supported by at least one of said enclosure posts so as to give an appearance of being an integral garage rear wall; and a garage door supported by at least two of said enclosure posts and operatively moveable between an open position for entry of a vehicle into said carport and a closed position.

2. The enclosure of claim 1 wherein said first side wall has an open latticework construction.

3. The enclosure of claim 2 wherein said first side wall includes a base board, a top panel and spaced vertical strips.

4. The enclosure of claim 1 wherein said first and second side walls and said rear wall each has an open-type construction.

5. The enclosure of claim 4 wherein said open-type construction is a latticework construction.

6. The enclosure of claim 1 further comprising a top rail extending between said at least two enclosures posts above said garage door, and generally at said roof construction.

7. The enclosure of claim 1 wherein said carport support posts are secured upright by footings, and said enclosure posts are supported upright by footings.

8. The enclosure of claim 1 wherein said garage door when in the open position is generally up into said carport.

9. The enclosure of claim 1 further comprising a track extending and curving up into an interior of said carport for guiding said garage door between the open and closed positions.

10. The enclosure of claim 1 wherein four of said enclosure posts are at respective corners of said enclosure.

11. The enclosure of claim 1 wherein said rear wall comprises framing secured to at least one of said enclosure posts and paneling secured to said framing.

12. The enclosure of claim 1 wherein at least one of said walls is physically connected to said roof construction and provides no substantial load-bearing structural support thereto.

13. The enclosure of claim 1 wherein said garage door defines a first garage door, and further comprising a second garage door supported by said enclosure posts and opening up relative to said carport.

14. The enclosure of claim 13 wherein said first and second garage doors form at least a part of a front wall which extends at least substantially up to said roof construction so as to give the appearance of being an integral garage front wall.

15. The enclosure of claim 14 wherein said garage door forms part of a front wall, and said roof construction has an A-shape sloping on one side down towards said front wall and on an opposite side down towards said rear wall.

16. The enclosure of claim 1 wherein said first side wall includes a top horizontal rail spaced a slight distance below said roof construction, a bottom horizontal rail and a panel extending generally therebetween.

17. The enclosure of claim 16 wherein said panel is a latticework panel.

18. The enclosure of claim 16 wherein said panel is a solid panel.

19. The enclosure of claim 1 further comprising a pair of opposing channels supported by said enclosure posts, and said garage door includes opposing rollers, disposed and rolling in said channels.

20. The enclosure of claim 1 wherein said garage door is a segmented manually roll-up garage door.

21. The enclosure of claim 20 further comprising a track curving up into said carport and along which said garage door is guided between the open and closed positions.

22. The enclosure of claim 21 wherein said roof construction includes a roof and at least one beam supporting said roof, and an upper portion of said track is mounted to said beam.

23. The enclosure of claim 1 wherein said garage door defines a first garage door on a wall forming in part a front carport enclosure wall, and further comprising a second garage door on said front carport enclosure wall and operable independently of said first garage door, and thereby first and second vehicle stalls are defined underneath said roof construction.

24. The enclosure of claim 23 wherein said first garage door is a single-wide garage door and said second garage door is a double-wide garage door.

25. The enclosure of claim 1 wherein said rear wall is disposed generally underneath said roof construction.

26. The enclosure of claim 1 wherein said carport support posts are secured upright in footings.

27. The enclosure of claim 1 wherein said enclosure posts are secured upright spaced a distance from and horizontally outboard of said carport support posts.

28. The enclosure of claim 1 wherein said first and second sidewalls are both supported entirely by said enclosure posts.

29. The enclosure of claim 28 wherein said rear wall is supported entirely by said enclosure posts.

30. A method of constructing a carport enclosure, comprising the steps of:

providing a carport enclosure including a plurality of upright carport support posts, and a roof construction supported by and generally overhanging the support posts, the support posts and the roof construction defining a carport which is open substantially on all sides thereof;

securing a plurality of enclosure posts upright and spaced outboard of the carport support posts;

attaching a first side wall to and supported by at least one of the enclosure posts, disposed generally underneath the roof construction and extending at least substantially up thereto so as to give an appearance of being an integral garage side wall;

attaching a second side wall to and supported by at least one of the enclosure posts, disposed generally underneath an opposite side of the roof construction and extending at least substantially up thereto so as to give an appearance of being an integral garage side wall;

attaching a rear wall to and supported by at least one of the enclosure posts so as to give an appearance of being an integral garage rear wall; and installing a garage door supported by at least two of the enclosure posts and operatively moveable between an open position for entry of a vehicle into the carport and closed position.

31. The method of claim 30 wherein the first side wall has an open latticework construction.

32. The method of claim 30 wherein each of the first and second side walls and the rear wall has an open-type construction.

33. The method of claim 32 wherein the open-type construction is a latticework construction.

34. The method of claim 30 wherein the carport support posts are secured upright by footings, and the enclosure posts are supported upright by footings.

35. The method of claim 30 wherein the garage door when in the open position is disposed generally up into the carport.

36. The enclosure of claim 30 wherein said garage door installing step includes installing a track extending and curving up into an interior of the carport for guiding the garage door between the open and closed positions.

37. The method of claim 30 wherein the garage door defines a first garage door, and further comprising installing a second garage door supported by the enclosure posts and opening up and into the carport.

38. The method of claim 37 wherein the first and second garage doors form at least a part of a front wall which extends at least substantially up to the roof construction so as to give the appearance of being an integral garage front wall.

39. The method of claim 30 wherein said garage door installing step includes installing a pair of opposing channels supported by the enclosure posts, and the garage door includes opposing rollers, for rolling in the channels.

40. The method of claim 30 wherein the garage door is a segmented manually roll-up garage door.

41. The method of claim 40 further comprising a track curving up into the carport and along which the garage door is guided between the open and closed positions.

42. The method of claim 41 wherein the roof construction includes a roof and at least one beam supporting the roof, and an upper portion of the track is mounted to the beam.

43. The method of claim 30 wherein the garage door defines a first garage door on a wall forming in part a front carport enclosure wall, and further comprising installing a second garage door on the front carport enclosure wall and operable independently of the first garage door, and thereby first and second vehicle stalls are defined underneath the roof construction.

44. The method of claim 43 wherein the first garage door is a single-wide garage door and the second garage door is a double-wide garage door.

45. The method of claim 30 wherein the carport support posts are secured upright in footings.

* * * * *